United States Patent [19]

Furuhashi

[11] 4,298,941

[45] Nov. 3, 1981

[54] METHOD FOR CONTROLLING AN INTERNAL COMBUSTION ENGINE

[75] Inventor: Toshio Furuhashi, Mito, Japan

[73] Assignee: Hitachi, Ltd., Tokyo, Japan

[21] Appl. No.: 121,476

[22] Filed: Feb. 14, 1980

[30] Foreign Application Priority Data

Feb. 19, 1979 [JP] Japan ..... 54-17329

[51] Int. Cl.[3] ..... F02P 5/08; F02P 3/02; F02B 5/02

[52] U.S. Cl. ..... 364/431; 123/417; 123/602; 123/609; 123/612; 364/569

[58] Field of Search ..... 364/431, 569; 123/416, 123/417, 421, 424, 602, 609, 610, 612

[56] References Cited

U.S. PATENT DOCUMENTS

| | | | |
|---|---|---|---|
| 3,926,557 | 12/1975 | Callies et al. | 123/610 X |
| 4,051,822 | 10/1977 | Yoshida | 123/609 X |
| 4,191,144 | 3/1980 | Nohira et al. | 123/417 |
| 4,201,159 | 5/1980 | Kawai et al. | 364/431 X |
| 4,210,111 | 7/1980 | Hattori et al. | 123/416 X |
| 4,217,868 | 8/1980 | Gräther et al. | 123/416 |
| 4,230,078 | 10/1980 | Hattori et al. | 123/609 X |
| 4,231,091 | 10/1980 | Motz | 364/431 |

*Primary Examiner*—Felix D. Gruber
*Attorney, Agent, or Firm*—Craig and Antonelli

[57] ABSTRACT

The previous ignition timing is used as a starting point for repititive ignition cycles to define the primary coil current flow starting point, in order to secure a sufficient current flow duration for the primary coil current that is supplied to an ignition coil to thereby prevent a shortage of ignition energy. An arithmetic circuit including a central processor produces data representing the duration between the previous ignition timing and the primary coil current flow starting point. A counter starts this counting operation from the previous ignition timing. The primary coil current feed to the ignition coil starts at a time when the contents of the counter are coincident with the result of the processor produced data.

The data is obtained by subtracting a necessary primary current flow duration or time from the interval between the previous ignition timing and the present ignition timing.

20 Claims, 12 Drawing Figures

METHOD FOR CONTROLLING AN INTERNAL COMBUSTION ENGINE

The invention relates to a method for controlling an ignition device for an internal combustion engine and, more particularly, to a method for electronically controlling the ignition device.

There has been proposed a method for digitally controlling the ignition timing of an internal combustion engine. By reason that the control in an ignition system is inherently synchronized with the rotation of the engine, the ignition timing and the current flow duration of the primary coil current of the ignition coil are controlled on the basis of a fixed crank angle of the engine rotation angle as a reference point. Practical running of the engine, however, has shown that such an ignition control method causes insufficient energy for ignition.

With the reference point of the fixed crank angle, a period of time between the fixed angle and the ignition time point is the current flow duration of the primary coil current. At a high speed of rotation of the engine crankshaft, the time period between the fixed crank angle and the ignition time point is shorter, so that insufficient energy is stored in the ignition coil and eventually insufficient ignition energy is obtained. The high speed rotation also has a tendency to advance the ignition timing. As a result, the phase angle between the fixed crank angle and ignition timing is small and thus the charging or storage time for the ignition coil is shorter. Such an inadequate energy charging time results in a deficiency of ignition energy, as a matter of course.

Accordingly, an object of the invention is to provide a method for controlling an ignition device for an internal combustion engine which is capable of providing a sufficient energy charging time for the ignition device to ignite fuel supplied to an engine.

According to an aspect of the present invention, there is provided a method for controlling a combustion engine having an output shaft driven by mechanical energy converted from heat energy caused by combustion of fuel. The engine includes an electric source, an igniting means being coupled with the electric source to charge energy delivered from the electric source and to discharge energy used in the ignition of the fuel. Also included is a first detecting means being coupled with the output shaft of the engine for producing a reference signal in response to a predetermined rotation angle of the output shaft, for controlling the energy conversion in accordance with a condition of the engine. The igniting means includes a central processor having a memory, the central processor repetitively, sequentially and arithmetically calculating first and second values corresponding to a first timing of the energy storage and to a second timing of the energy discharge and being programmed to perform a calculation using functions defining a desired relationship between the condition of the engine and the first and second timings. The method comprises the steps of producing an electrical signal in the form of a digital signal, the digital signal indicating a condition of the engine; calculating the first value, corresponding to the first timing to store energy, by the central processor; calculating a second value, corresponding to the second timing to discharge the energy, by the central processor using the electrical signals indicating the condition of the engine; generating a first control signal at the first timing to store the energy delivered from the electric source in accordance with the first calculated value, the generation of the first control signal being performed by starting a count in response to the second timing and by producing the first control signal when the counted value reaches the first calculated value; generating a second control signal at the second timing to discharge the energy used in ignition in accordance with the second calculated value, the generation of the second control signal being performed by starting a count in response to a reference signal produced by the first detecting means and by producing the second control signal when the counted value reaches the second calculated value; and storing the energy delivered from the electric source in accordance with the first control signal and discharging the energy used in the ignition in accordance with the second control signal. The method is improved in that the step of calculating the first value includes a first step of producing first data indicative the interval between the present second timing and the previous second timing calculated by the central processor, a second step of producing second data indicative of the duration needed for storing the energy delivered from the electric source, a third step of calculating the first value from a function subtracting the second data from the first data and a fourth step of generating the first control signal by starting the count in response to the previous second timing and producing the first control signal.

According to another aspect of the present invention, there is provided a method for controlling a combustion engine having an output shaft driven by mechanical energy converted from heat energy caused by combustion of fuel, the engine including, for controlling the energy conversion in accordance with a condition of the engine, an electric source, an igniting means coupled with the electric source to store energy delivered from the electric source and to discharge energy used in the ignition, and a first detecting means, coupled with the output shaft of the engine, for producing reference signals and position signals in synchronization with the rotation of the output shaft. The igniting means includes a central processor repetitively, sequentially and arithmetically calculating first and second values corresponding to a first timing for storing energy and to a second timing for discharging the ignition energy respectively and being programmed to perform calculations using functions defining a desired relationship between the condition of the engine and the first and second timings. Also included is a first means, coupled with the first detecting means and the central processor, to start, in response to a reference signal, an operation counting position signals and to produce a first control signal when the counted value reaches the second value delivered from the central processor, second means, coupled with the first detecting means and the central processor to start, in response to the first control signal produced by the first means, an operation counting position signals and to produce a second control signal when the counted value reaches the first value delivered from the central processor, and a third means for storing energy delivered from the electric source and for discharging ignition energy in response to the first and second control signals. The method comprises the steps of: producing digital signals, the digital signals indicating the condition of the engine; calculating the first value, corresponding to the first timing to store ignition energy, by the central processor; and calculating the second value, corresponding to the second timing to discharge the energy, by the central processor using the digital signals indicating the condition of the engine. The method is improved by the fact that the step for calculating the first value further includes a first step for calculating first data corresponding to the number of position signals between the present second timing and the previous second timing; a second step for calculating second data corresponding to the number of position signals corresponding to the time duration required for storing the energy; and a third step for calculating a first value by subtracting the second data from the first data.

An engine unit to which the invention is applied has an engine, a fuel supply means for supplying fuel to the engine, an igniting or ignition means for igniting the fuel supplied, and an output shaft driven by mechanical energy converted from heat energy produced from the fuel supplied. The igniting means includes an igniting energy generating means in which electric energy supplied from a power source is stored and then discharges for igniting the fuel and an electronic means for controlling the energy charging or storage timing (DWL timing) and the ignition energy discharging timing of the igniting energy generating means. The electronic means includes a plurality of sensors for sensing conditions of the engine and a reference angle sensor for producing a reference angle signal (REF) in synchronism with the rotation of the output shaft of the engine unit, means for producing binary signals in accordance with the output signals produced by the sensors, and a central processor. In order to control the energy conversion process for converting heat energy into mechanical energy on the basis of the conditions of the engine detected by the sensors, the central processor repetitively, sequentially and arithmetically calculates first and second values (DDWL and DIGL) corresponding to the energy charging or storage timing (DWL timing) and the ignition energy discharging timing (IGN timing). The ignition means is charged with electric energy from the electric source on the basis of the first value (DDWL) and discharges the igniting energy on the basis of the second value (DIGN), whereby the energy conversion process is controlled.

With respect to the calculations of the first and second values (DDWL and DIGN), the central processor is so programed as to perform the calculation of the second values by using functions describing a desired relationship between a condition of the engine and the ignition energy discharge timing (IDN timing) and to perform the following steps to calculate the first value (DDWL): (a) a step of producing first data indicative of an interval between the present and previous IGN timings, (b) a step of producing second data indicative of a duration taken for charging the electric energy supplied from the power source, and (c) a step of producing the first value by subtracting the second data from the first data.

The first value (DDWL) thus calculated provides the DWL timing by determining the interval between the previous IGN timing and the DWL timing. The IGN timing constantly changes depending on a condition of the engine. The engine condition used for calculating the present IGN timing is quite similar to that used for calculating the previous IGN timing. Accordingly, a variation of the present IGN timing is similar to that of the previous IGN timing. Therefore, the interval between the present and previous IGN timings is large and is substantially equal to the interval between the reference angle signals. In the present invention, the energy storage starting point for the present ignition is determined with the reference point of the previous IGN timing, so that the charging on storage time for the present ignition may be set to be approximate to the interval between the reference angle intervals, if necessary. Consequently, it is possible to obtain a time period long enough to charge the energy. As a result, the igniting means may discharge sufficient igniting energy.

The above and other objects, features and advantages of the invention will be more clear from the following description taken in connection with the accompanying drawings, in which:

FIG. 1 schematically illustrates an ignition control system;

FIG. 2, including A–C, diagrammatically illustrates the relation between the output signal of the ignition control system and the primary current of an ignition coil;

Figure 1:
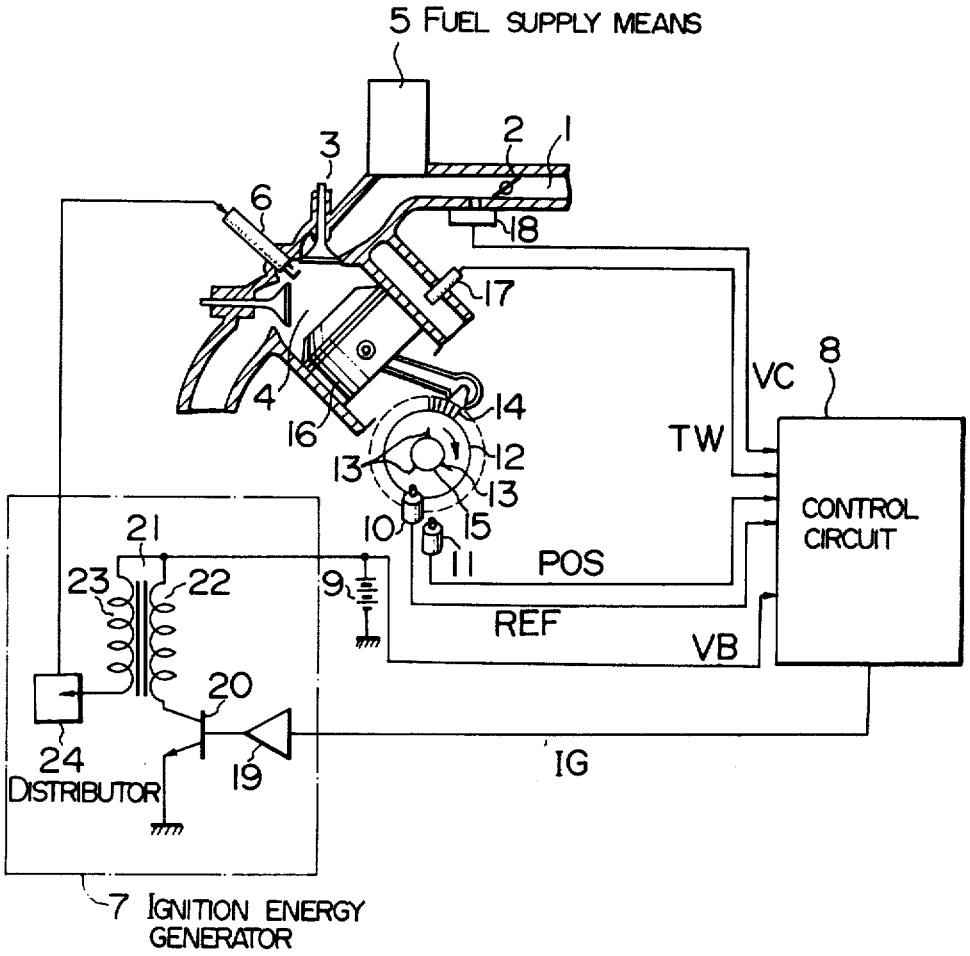

Referring now to FIG. 1, there is shown the substantial part of an engine system. In the figure, air is drawn into a combustion chamber 4 of a cylinder, through an intake valve 3 in accordance with the opening of a throttle valve 2 provided within an intake manifold 1. Fuel supplied from a fuel supply means 5 is mixed with air to form a fuel-air mixture and the fuel-air mixture is introduced into the combustion chamber 4 through the opening of a intake valve 3. The engine system has an ignition means which includes an electronic control circuit 8, an ignition energy generator 7, an ignition plug 6 for igniting the fuel-air mixture within the combustion chamber 4, and a plurality of sensors. These sensors include a negative pressure sensor 18 for detecting negative pressure in the intake manifold 1 to check the load condition of the engine, a water temperature sensor 17 for detecting temperature of cooling water of the engine, and angle sensors 10,11 for producing output signals representing the rotation angle of an engine shaft 15. A disc 12 with projections 13 and 14 is mounted on the engine shaft 15. In the embodiment of a six-cylinder engine, those projections are disposed on the periphery of the disc 12 at intervals corresponding to the six-cylinder engine, as shown. The projections 14 are provided on the entire periphery of the disc 12 at angular intervals of 1°, with relation to a sensor 11. The sensor 11 produces a pulse every 1° of rotation of the engine shaft 15. The pulse produced by the sensor 11 will be referred to as a POS pulse. The projections 13 are disposed at angular intervals of 120°, with relation to a sensor 10. The sensor 10 produces a pulse every 120° of rotation of the engine shaft 15. The pulse produced by the sensor 10 will be referred to as an REF pulse. As mentioned above, since the embodiment employs the six-cylinder engine, the REF pulse is generated every 120° rotation of the engine shaft 15. Accordingly, the REF pulse is generated every 180° rotation for a 4-cylinder engine. Similarly, it is produced every 90° rotation for an 8-cylinder engine.

The POS pulse, the REF pulse, an analog voltage VC representing intake manifold pressure, which is produced by a sensor 18, an analog voltage TW produced from water temperature sensor 17 and a voltage VB from an electric source 9 are applied to electronic control circuit 8. Responding to those input signals, the control circuit 8 applies a rectangular wave signal IG to a power transistor 20 via an amplifier 19 in ignition energy generator 7. The voltage VB from the electric source 9 is applied to the primary coil 22 of an ignition coil 21, to thereby turn on the power transistor 20. As a result, current flows from the power source 9 into the primary coil where the current is stored in the form of magnetic energy. Then, the power transistor 20 is turned off, to shut off the current flowing through the primary coil 22 of the ignition coil. Upon the shut off of the primary current, a high voltage occurs in the secondary coil 23, which the high voltage is applied through a distributor 24 to an ignition plug 6 through which it is discharged as ignition energy.

Figure 2:
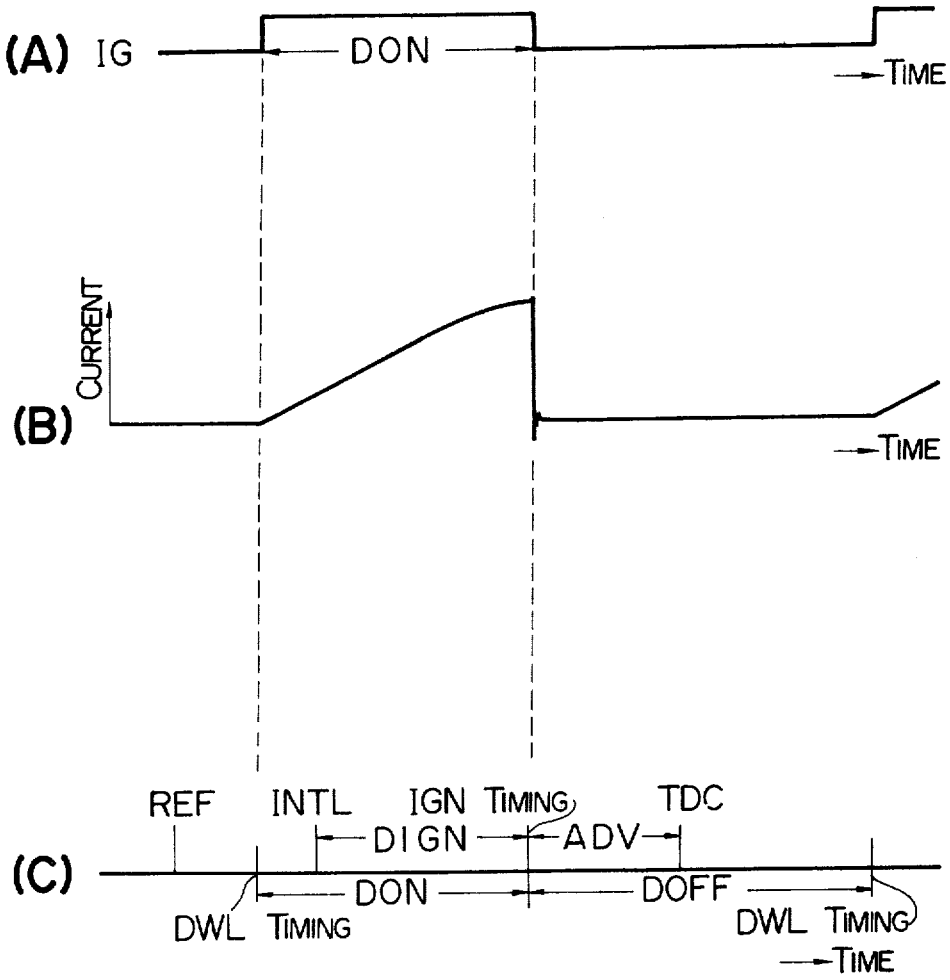

Turning now to FIG. 2, there is shown the relation between the output signal IG from the control circuit 8 and the primary coil current of the ignition coil 21. In the figure, the rectangular wave signal denoted as IG is applied to the power transistor 20 by way of amplifier 19. The rectangular wave signal IG causes current to flow through the primary coil 22 of the ignition coil 21. The current of the primary coil 22 has a waveform as shown in FIG. 2(B).

The power transistor 20 is turned on at the leading edge of the rectangular voltage shown in FIG. 2(A) and the primary coil current rises as shown in FIG. 2(B). The power transistor 20 is turned off at the trailing edge of the rectangular voltage and at this point in time the primary coil current is shut off as shown in FIG. 2(B) to ignite the fuel. In FIG. 2(C), TDC represents top dead center of a engine. In the six-cylinder engine, one of the cylinders reaches top dead center every 120° rotation of the engine shaft. ADV represents an ignition timing which is represented by a crank angle from the instant that the ignition occurs until top dead center. INTL is a reference angle set by the REF pulse shown in FIG. 1, and is disposed every 120° on the time scale shown in FIG. 2(C), in this embodiment. The shut off time point of the primary coil current, i.e. ignition timing (IGN timing), depends on an angle D IGN from the reference angle INTL. Accordingly, the control of the ignition timing ADV is controlled by changing the angle D IGN. The current flow starting point (DWL timing) of the primary coil, i.e. the timing (D ON) to turn off the power transistor 20, is set with respect to the IGN timing preceding to the present one, and is controlled by adjusting an angle D OFF measured from the previous IGN timing.

As described above, there are two functions to be controlled in the ignition device; one is the ignition timing as an ignition energy discharge timing, or the shut-off point of the primary coil current; the other is the energy charging timing or the current flow starting point of the primary coil. These two items of information are produced from the control circuit 8 in the form of a rectangular pulse. As mentioned above, the leading edge of the rectangular pulse IG is the current flow starting point of the primary coil while the trailing edge of it is the ignition timing.

Control of the ignition timing corresponds to control of the combustion starting point of the fuel-air mixture in each cylinder and through this control the internal pressure rise or temperature rise in each cylinder may be controlled. Through the control of the current flow starting point of the primary coil of the ignition coil, it is possible to control the conduction duration D ON of the power transistor shown in FIG. 2 and, therefore, to control the primary coil current of the ignition coil, i.e. the ignition energy. The rise time of the primary coil current depends on the circuit constant of the primary coil and the voltage supplied from the electric source. The circuit constant may be considered almost unchanged, while the voltage supplied changes. Assume now that the voltage is fixed and the energy charging time, or the time duration to feed current into the ignition coil, is fixed. In this case, the shut-off current of the ignition coil, i.e. spark energy, is constant. Therefore, it is necessary to control the current flow starting point (first timing) so that the current flow of the primary coil always starts prior to the ignition timing by a fixed time. Actually, however, control is necessary so that the current flow duration is long when the voltage is low while it is short when the voltage is high, since the voltage of the electric source varies. Those factors are properly processed by the control circuit 8 and the circuit 8 produces the result of the processing in the form of the rectangular pulse IG.

Figure 3:
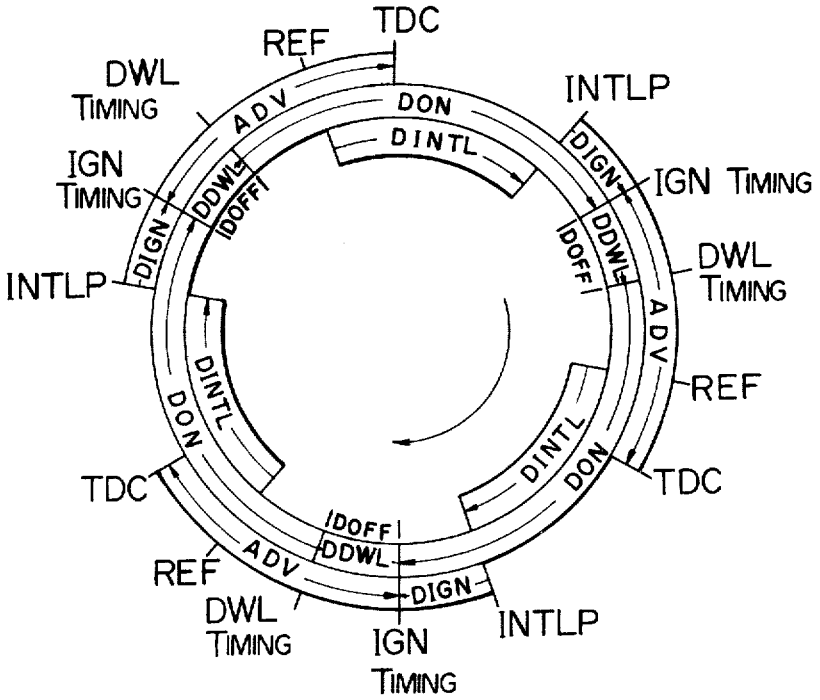
FIG. 3 is a diagram useful in explaining the operation of the ignition control system shown in FIG. 1.

Turning to FIG. 3, there is shown a sequence of controls in the ignition system with respect to the engine shaft. As shown, the TDCs of eacy cylinder are preset at intervals of 120° and the REF pulses occur at the same intervals. The REF pulse may be generated at the TDC position if the disc 6 is positioned with respect to the sensor 10 in a given relation. In fact, however, the structure of the engine frequently makes it difficult to position them in such a relation. In the embodiment, it is assumed accordingly that the REF pulse is not coincident with the TDC in the time position. The INTL pulse is produced in accordance with the REF pulse. The INTL pulse is used a reference in the ignition control. Therefore, the INTL pulse is produced at an angular position where the control system of the ignition device may be controlled most easily. Since the INTL pulse is produced on the basis of the REF pulse, the INTL pulse also is produced for each 120° in the embodiment under discussion.

A computer in the control circuit 8 calculates D IGN (the angle measured from the reference angle (INTL)). The ignition is performed at an angular position rotated by D IGN from INTL. This ignition timing, or an advance angle, relative to TDC is expressed as ADV.

The point where the current starts to flow into the primary coil of the ignition coil is the angular position rotated by D OFF from the previous ignition timing. Accordingly, current flow in the primary coil continues during D ON. The method of employing the previous ignition timing as a reference in setting the current flow starting point in the primary coil makes the D ON angle larger than that employing INTL or TDC as a reference. Accordingly, when the former method is employed, a sufficient energy charging time is ensured to allow a sufficient amount of current to be fed to the primary coil. In particular, once the positions of TDC and INTL have been established, they are always fixed with respect to the rotation of the engine crankshaft. Accordingly, when the ignition time ADV is large at a high engine speed, the interval between the ignition timing and TDC or INTL is small, so that D ON is insufficient. Particularly at a high engine speed, the ratio of D ON to the fixed time is large, so that the magnitude of D ON require to keep current flowing in the primary coil is large. To solve this problem, the fixed reference point for determining the current flow starting point of the primary coil is inferior to a floating reference which changes with the advance angle. In this respect, the method using the previous ignition timing as the reference is very advantageous.

Figure 4:
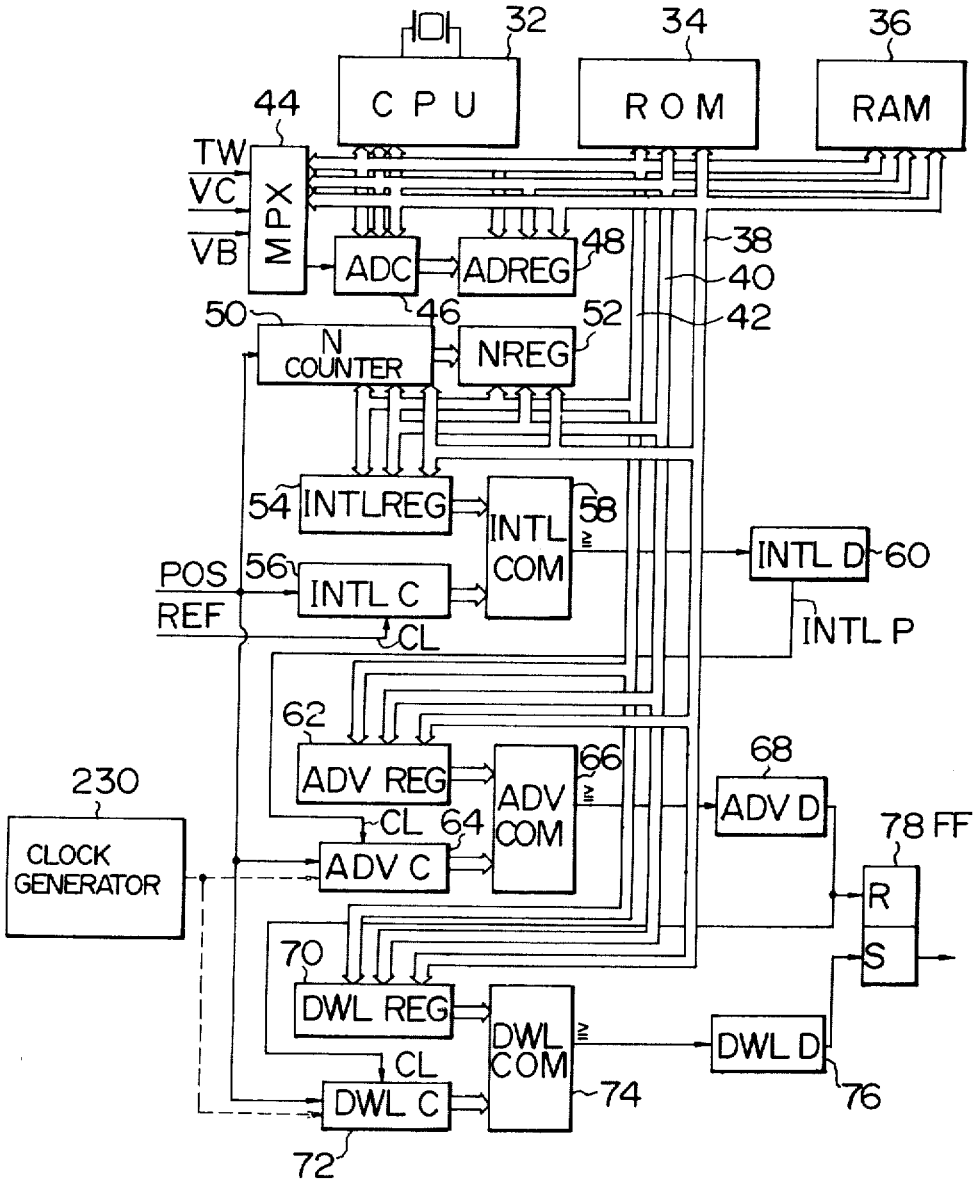
FIG. 4 is a block diagram of the ignition control system shown in FIG. 1.

Reference is made to FIG. 4 illustrating details of the control circuit 8 shown in FIG. 1. A central processing unit (CPU), a read only memory (ROM) and a random access memory (RAM) are connected to one another by a control bus 38, an address bus 40 and a data bus 42. In an analog to digital converting system, a multiplexer (MPX) 44, an analog to digital converter (ADC) 46, and a digital value holding register (ADREG) 48 are coupled with the CPU 32, the control bus 38, the address bus 40 and the data bus 42. On the basis of the data from the CPU 32, the MPX 44 selects the negative pressure signal VC or the water temperature signal TW and applies the selected one to the ADC 46. In response to a start signal from the CPU 32, the ADC 46 converts an analog signal from the MPX 44 into a corresponding digital signal and sets the digital signal in the ADREG 48. In response to a read signal delivered through the control bus 38 and upon the designation of the ADREG by the address bus, the digital value loaded into the CPU 32 by way of the data bus 42 and is used therein for various computations.

Engine speed data are taken into the CPU 32 through the combination of a counter 50 (N counter) and a latch circuit 52 (NREG). The N counter 50 counts POS pulses during a period of time designated by the CPU 32. After the time period designated, the contents of the POS pulses in the N counter 50 are latched in the NREG 52 and the N counter 50 is cleared. Then, the N counter 50 counts again the POS pulses for the designated time period by the CPU 32, and is latched in the NREG 52. The contents of the NREG 52 are loaded into the CPU 32 through the data bus 42 on the basis of the values from the control bus 38 and the address bus 40.

The formation of the INTL pulse from the REF pulse in FIG. 3 is performed through the combination of a register INTLREG 54, a counter INTLC 56, a comparator INTLCOM 58, and a monostable-multivibrator INTLD 60. The number of the POS pulses corresponding to the phase angle between the REF pulse and the INTL pulse is set in the INTLREG 54 by the CPU 32. The digital value representing the number of the POS pulses is denoted as DINTL in FIG. 3 and is stored in the ROM 34. The counter INTLC 56 is cleared by the REF pulse and afterward counts the POS pulses. When the count of the counter INTLC 56 exceeds the value of DINTL set in the INTLREG 54, the output signal from the comparator INTLCOM 58 rises and, in response to the rise of the output signal from the INTLCOM 58, monostable-multivibrator INTLD 60 produces an INTLP pulse. The INTLP pulse is used as a reference pulse for setting the IGN timing (ignition timing).

The explanation to follow is for the generation of the ignition pulse. The CPU 32 sets the number of the POS pulses corresponding to D IGN in a register ADVREG 62. By the INTLP pulse produced by the INTLD monostable-multivibrator 60, a counter ADVC 64 is cleared and counts POS pulses. When the count of the ADVC 64 exceeds the value set in the ADVREG 62, the output signal from a comparator ADVCOM 66 rises and, in response to the rise of the output signal, a monostable-multivibrator 68 produces an output signal and the output signal from a flip-flop 78 changes state. The change in state of the output of flip-flop 78 turns off the power transistor 20 (FIG. 1) to start the ignition.

The control of the energy charging timing (DWL timing), i.e. the current passage starting point in the primary coil of the ignition coil, is performed by the combination of a register DWLREG 70, a counter DWLC 72, and a comparator DWLCOM 74. The number of POS pulses corresponding to D OFF between the IGN timing and the DWL timing (FIG. 3) is set in the DWLREG 70. The counter DWLC 72 is cleared by the pulse of the previous DWL timing, or the output signal from the ADVD 68, and counts the POS pulses. When the count of the counter DWLC 72 exceeds a value (DDWL) corresponding to DOFF set in the DWLREG 70, the output signal of the comparator DWLCOM 74 rises and the rise of the output signal triggers the monostable-multivibrator DWLD 76. The output from the DWLD 76 sets a flip-flop 78, so as to turn on the power transistor 20 shown in FIG. 1.

Figure 5:
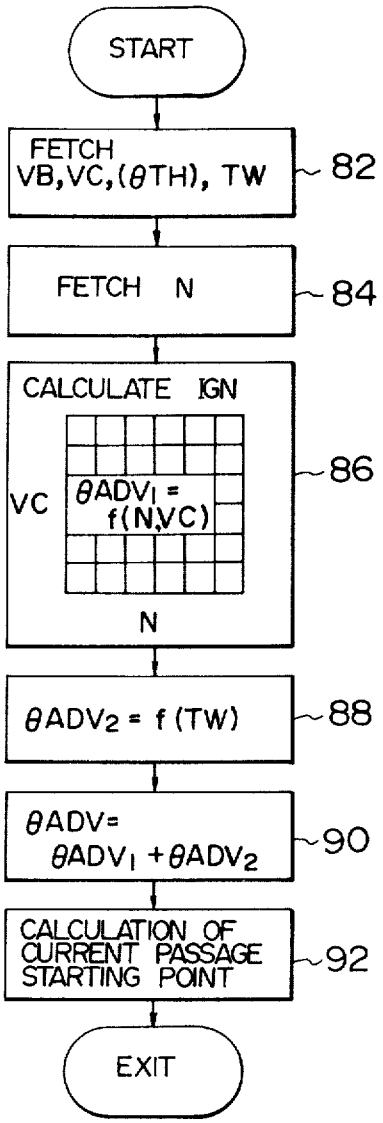
FIG. 5 shows a flow chart for illustrating a control flow of the ignition control system.
Figure 6:
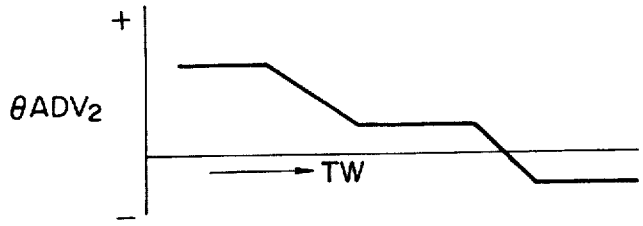
FIG. 6 is a variation of a factor $\theta$ADV2 of the ignition timing (IGN timing) with respect to water temperature.

FIG. 5 shows a flowchart of the calculation of the data set in the registers ADVREG 62 and DWLREG 70 shown in FIG. 4. In a step 82, the voltage VB, the negative pressure VC and the water temperature TW are taken out from the ADREG 48 in FIG. 4 in digital form and loaded into the RAM 36. In the embodiment, the negative pressure VC is measured but a throttle angle $\theta$ TH may be taken or fetched in place of the former. In a step 84, engine speed N is taken out or fetched from the NREG 52. In a step 86, a map in the ROM 34 is searched by using the data N and the negative pressure VC to obtain a factor $\theta$ADV1 as one of the factors of the ignition timing which, in turn, is recorded in the RAM 36. In a step 88, another factor $\theta$ADV2 is calculated. The factor $\theta$ADV2 varies with respect to water temperature, as shown in FIG. 6, for example. A step 90 adds those two factors $\theta$ADV1 and $\theta$ADV2. Through those steps, $\theta$ADV corresponding to ADV in FIG. 3 may be obtained.

The INTLP pulse in FIG. 3 is produced every 120° of the crank angle and the angle 120° is fixed, as described above. Accordingly, the crank angle between the INTLP pulse and the next TDC is fixed. The result $\theta$IGN of the subtraction of the angle $\theta$ADV calculated in the step 90 from the fixed crank angle is set in the register ADVREG 62. At the same time, DADV is recorded in the RAM 36 to calculate the succeeding current flow starting point.

The calculation flow advances to a step 92 where the DOFF angle in FIG. 3 is calculated and the calculated angle is set in the register DWLREG 70. At this point, an task expressed by the flowchart in FIG. 5 ends.

An explanation to follow is the elaboration of the calculation in the step 92 in the flow chart in FIG. 5. DOFF in FIGS. 2 and 3 will be calculated. There are three factors to determine DOFF. The first factor is the difference ΔADV between the previous ignition timing ADV (PREVIOUS) and the present ADV (PRESENT). This factor arises from the method in that the current flow starting point in the primary coil is set with respect to the previous ignition timing as a reference point. The second factor is the engine speed. The primary current flow time of the ignition coil depends on the voltage across the electric source and it must be independent of a change of engine speed. However, the primary current flow duration is converted into a corresponding crank angle for its control. For this, the engine speed must be considered. The third factor is the voltage VB. Accordingly, the crank angle DOFF is given $$DOFF = f(\Delta ADV, N, VB) \quad (1)$$

Let us consider first a relation between the ΔADV and the DOFF. ΔADV is defined by the following equation $$\Delta ADV = ADV\ (PRESENT) - ADV\ (PREVIOUS) \quad (2)$$

It is assumed further that the engine speed N and the voltage VB are unchanged. When the present ADV (PRESENT) is larger (i.e. DIGN is smaller) than the previous DIGN in ADV register 62 ADV (PREVIOUS), DOFF must be reduced by this amount ΔADV. Accordingly, the following equation holds $$DOFF = \theta INTL - DON - \Delta ADV \quad (3)$$

where θINTL is the angular interval between the REF pulses from the angle sensor 10. θINTL−ΔADV indicates the interval between the present ignition timing and the previous ignition timing. In case that a high accuracy is not required for control, the ΔADV is negligible and θINTL may be considered as the interval between the present ignition timing and the previous ignition timing.

θINTL is related to the number of cylinders by:

$$\theta INTL = 360°/KCYL \quad (4)$$

where KCYL, a value determined depending on the number of cylinders, is approximated to half of the number of cylinders. In the equation (3), DON is the period of time that primary current flows through the ignition coil 21.

Let us consider the relation between DOFF and engine speed N as the second factor. A time τ required for an angle θ of rotation when the engine speed is N (r.p.m.) is by:

$$\tau(sec) = \theta/6N \quad (5)$$

Accordingly, the number Pn of the POS pulses produced from the sensor 11 during a fixed time interval τn is related to the number of revolutions by the following expression:

$$Pn\ (number\ of\ pulses) = 6N/\theta POS \times \tau n \quad (6)$$

where POS is the crank angle representing the POS pulse generating period and is 1° in this embodiment. The equation (6) defines the manner in which the count of the counter 50 changes in accordance with engine speed, when the CPU directs the N counter 50 to count the number of the POS pulses during the period τn(sec) in FIG. 4. The engine speed N may also be calculated by using the count Pn (the number of pulses) in the following manner:

$$N\ (r.p.m.) = 1/6 \times \theta POS/\tau n \times Pn \quad (7)$$

Referring again to FIG. 2, let us consider the crank angle DON corresponding to the primary current passage duration τON. The current flow duration τON depends on the voltage VB across the electric source and will be referred to how the duration τON is determined. It is assumed now that the duration τON has already been determined. DON, when the engine speed, is N (r.p.m.) is expressed as:

$$DON = 6N \times \tau ON$$

As given by the equation, the N may be obtained from count Pn and we have $$DON = \tau ON/\tau N \times \theta POS \times Pn \quad (8)$$

The DOFF, during which primary current flows through the ignition coil, is $$DOFF = \theta INTL - DON$$
$$= \theta INTL - \tau ON/\tau N \times \theta POS \times Pn$$

DOFF is converted into a number of POFF of the POS pulses of the crank angle sensor by the following relation $$POFF = DOFF/\theta POS = \theta INTL/\theta POS - \tau ON/\tau N \times Pn \quad (9)$$
$$= PINTL - K1 \times Pn$$

where PINTL is the number of the POS pulses from the INTL signal to the succeeding INTL signal, that is, from the REF signal to the succeeding REF signal, and may be known previously, and K1=τON/τN and is the ratio of the measuring time τN of the POS pulse to the primary current flow duration τON.

Figure 7:
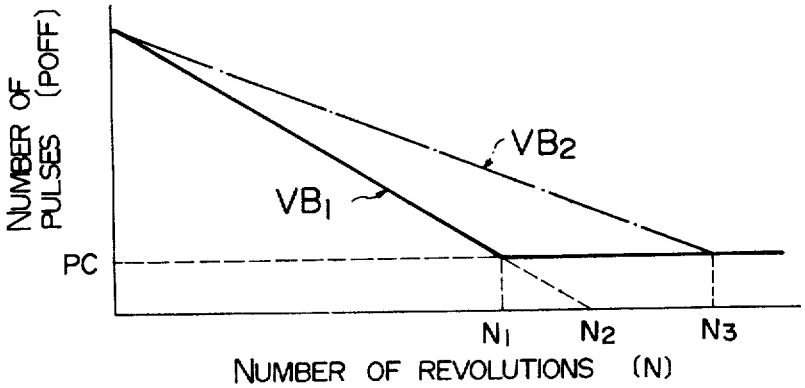
FIG. 7 shows a graph illustrating the relation between a P OFF signal and engine speed.

In the equation (9), the Pn increases with engine speed. Accordingldy, when the number of revolutions is large, POFF becomes zero. In FIG. 7 graphically illustrating equation (9), the number of POFF pulses decreases with a change of the engine speed as indicated by a continuous line and it becomes zero when N=N2. If POFF becomes zero, primary current flow is continually flowing. To prevent this, the power transistor 20 (FIG. 1) for current control must be turned off for a given number of pulses. Accordingly, POFF is set to a fixed value PC for an engine speed higher than N1 (r.p.m.).

Figure 8:
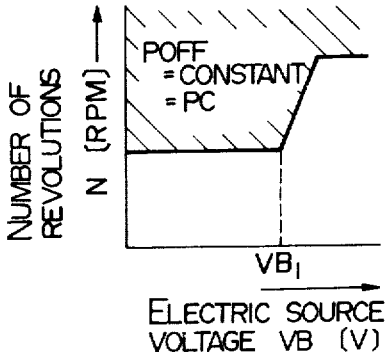
FIG. 8 illustrates a region where the quantity P OFF is constant.

In the above description, τON is assumed to be fixed. τON is the value where the voltage VB of the electric source is fixed, for example, VB1. However, when the voltage VB becomes large, τON becomes small, so that, even if the engine speed further increases, it is possible to ensure a fixed POFF, i.e. PC. For example, when the voltage VB becomes VB2, all one has to do is to set POFF to the fixed value PC with respect to the range above the engine speed N=N3 (FIG. 7). The engine speed from which POFF is set to the fixed value depends on the voltage VB, as shown in FIG. 8. Actually, the engine speed at the boundary of a range of the engine speed for setting POFF to the fixed value PC is a function of the voltage VB. However, the extent of change of the voltage VB may be predicted and is not so large. Accordingly, it is assumed that POFF within the voltage VB1 is fixed.

The relation between the primary current flow duration $\tau ON$ vs the voltage VB as the third factor will be described. The current flow duration for supplying current to the primary coil at a fixed value is a natural logarithm of a reciprocal of the voltage VB, as indicated by a continuous line shown in FIG. 9. This continuous curve is approximated to have a dotted straight line. Assume that proportional coefficients (proportional constant) with respect to the voltage VBO are KC1 and KC2. The primary current flow duration $\tau ON$ of the ignition coil is given by $$\tau ON = \tau ONO + KC\,(VBO - VB) \quad (10)$$

$$DON = PN/\tau N \times \theta POS \times \tau ON \quad (11)$$

$$= PN/\tau N \times \theta POS\,(\tau ONO + KC\,(VBO - VB))$$

$$= (\tau ONO/\tau N + KC/\tau N \times (VBO - VB)) \times \theta POS \times PN$$

In the equation (11), when $VB \leqq VBO$, $KC = KC1$ and when $VB > VBO$, $KC = KC2$. The number of the POS pulses corresponding to DON, denoted as PON, is given $$PON = (\tau ONO/\tau N + KC/\tau N \times (VBO - VB)) \cdot PN \quad (12)$$

From this, a pulse POFF when the transistor 20 is OFF is $$POFF = PINTL - (K1 + K2\,(VBO - VB)) \cdot PN \quad (13)$$

where $K1 = \tau ONO/\tau N$ and $K2 = KC/\tau N$.

As described above, when the first to third factors are all taken into account, POFF is $$POFF = PINTL - (K1 + K2\,(VBO - VB)) \cdot PN - \Delta\theta ADV/\theta POS \quad (14)$$

$$= PINTL - (K1 + K2\,(VBO - VB)) \cdot PN - PIG$$

where $PIG = \Delta\theta ADV/\theta POS$. The current flow starting point of the ignition coil is obtained by using the equation (14).

Figure 10:
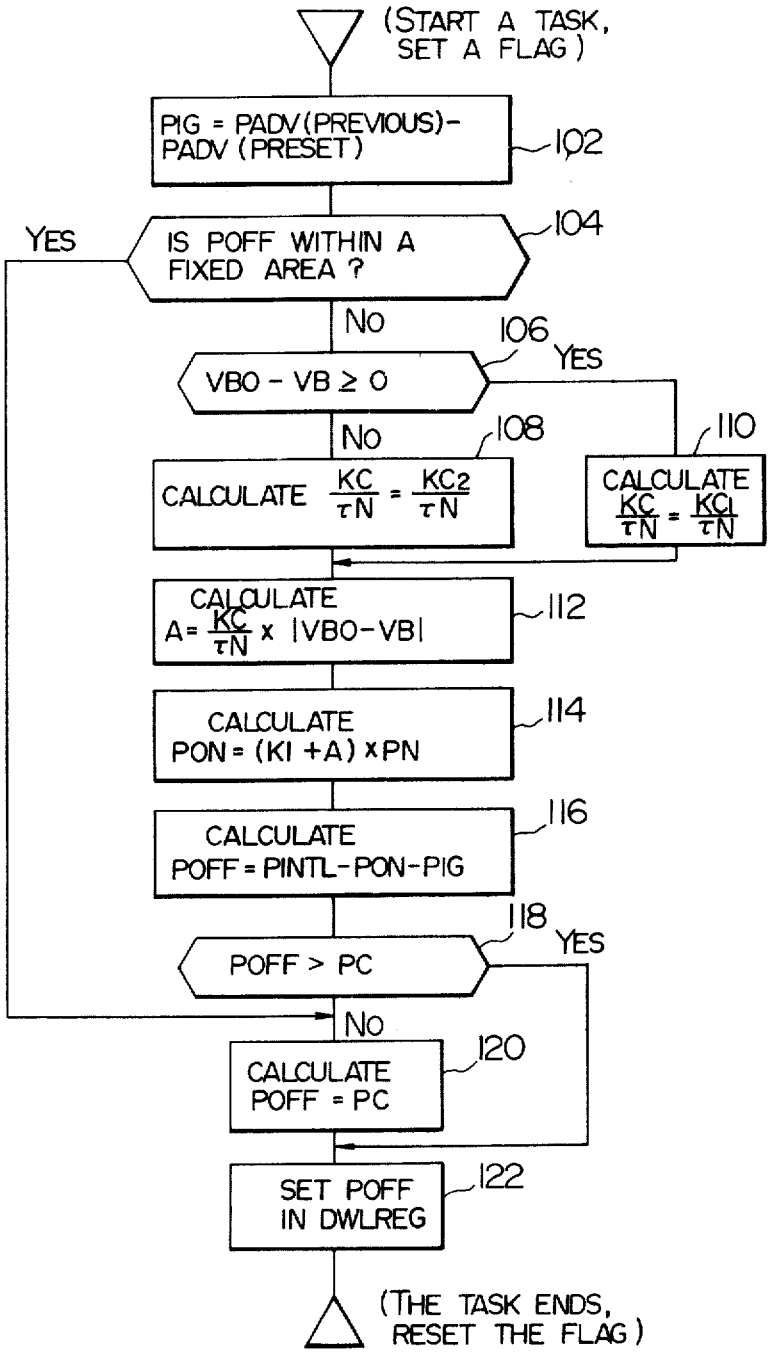
FIG. 10 is a flow chart of the detail of step 92 shown FIG. 5.

Reference is made to FIG. 10 illustrating how to calculate the current feed starting point to the ignition coil. The flow chart shown in FIG. 10 illustrates the details of the step 92 in FIG. 5. In step 102, the difference between the previous ignition timing (PREVIOUS) and the ignition timing $\theta ADV$ (PRESENT) to be controlled is obtained as the difference of the number of POS pulses. The difference of the number of POS pulses is denoted as PIG. A step 104 determines whether the ignition coil current shut-off angle exceeds the fixed value PC. This determination is performed on the basis of the characteristic curve in FIG. 8. The restricted area or fixed area (hatched area) of POFF in FIG. 8 defined by the electric source voltage VB and engine speed N (RPM) detected by the steps 82 and 84 in FIG. 5 is stored in the ROM in the form of a map. The determination as to whether POFF falls within the fixed area or not is made by searching the map in the ROM. The engine speed N to partially define the restricted area may be replaced by the period between reference crank angles. In this case, it is related to the number of revolutions in an inverse proportion. However, either technique may be employed in the invention and, accordingly, it is treated in the embodiment as a parameter including those. If POFF falls within the restricted area at the step 104, the CPU jumps to a step 120.

Figure 9:
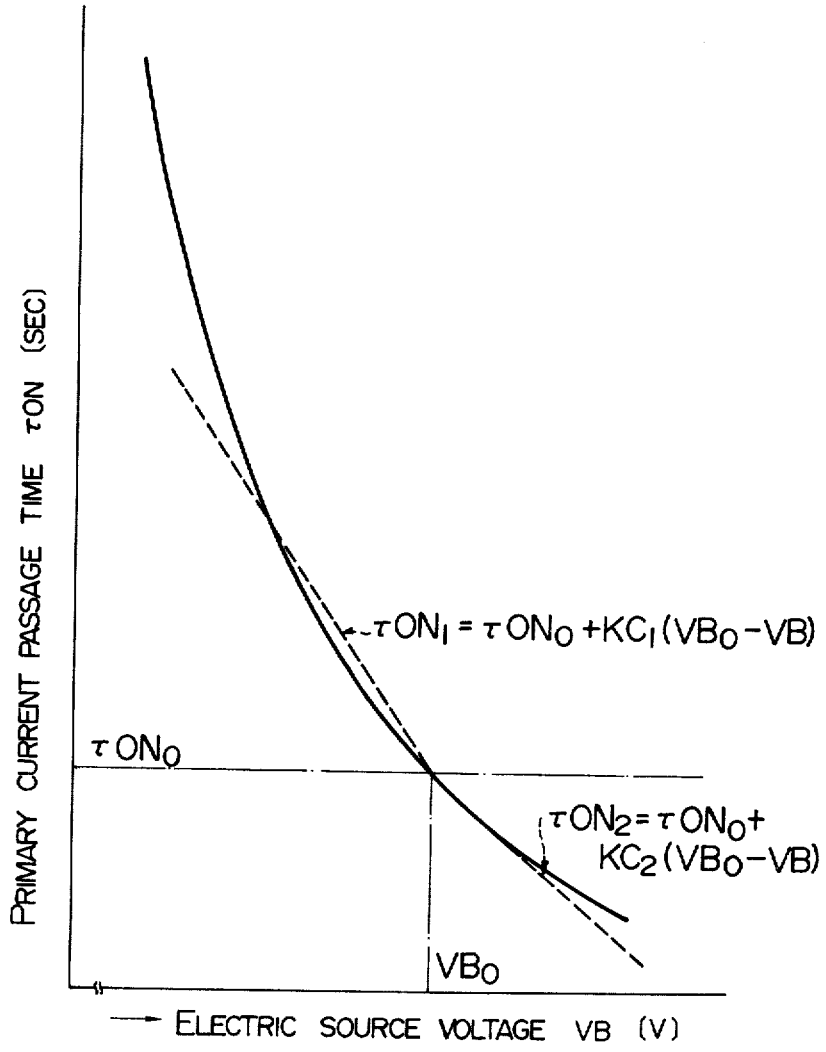
FIG. 9 is a characteristic curve describing the relation between an electric source voltage and the current flow duration of the primary current of the ignition coil.

If it does not fall within the area, the CPU advances to step 106 which compares the VBO in FIG. 9 with the actual VB. If $VBO \geqq VB$, KC is determined by using the characteristic in FIG. 9 with $KC1/\tau N$ as $KC/\tau N$. When $VBO < VB$, KC2 is used for KC. Here, KC1 and KC2 have already been calculated. $\tau N$ is a time period for measuring the number of POS pulses. Following the determination of KC in steps 108 and 110, PON is calculated through steps 112 and 114 and POFF is calculated in step 116. POFF calculated by the equation (14) and is expressed by PINTL-PON-PIG. Here, PIG is the difference between the ignition timing (previous IGN timing) as a reference and the ignition timing (present IGN timing) to be controlled and its value is small. Accordingly, the number of POS pulses PON representing the duration of primary current conduction is expanded up to a time corresponding to PITL. If POFF is zero, the power transistor 20 in FIG. 1 cannot be turned off. Therefore, POFF must be above that corresponding to the time to ensure the turn-off of the power transistor 20. This determination is made in step 118 to compare PC with the POFF. PC is the number of POS pulses corresponding to the time to ensure the turn-off of the transistor. If $POFF > PC$, the value of POFF, which is calculated, is set in the DWLREG 70 in FIG. 4. If $POFF < PC$, step 120 changes POFF to PC and step 122 sets the POFF value in the DWLREG 70. In this manner, the operation of the ignition system is performed and the ignition system is controlled by using the result of the operation.

As described above, the primary current feed starting point in the ignition coil is controlled by using an amount of phase shift measured from the previous ignition timing as a reference point. Accordingly, the current passage time or duration of the ignition coil may be controlled widely, so that a sufficient amount of ignition energy is ensured in a high engine speed region.

Additionally, the above-described embodiment of the invention can reliably secure a time period to ensure the turn-off of the power transistor 20 to shut off the primary current in the ignition coil. This prevents occurrence of accidents. In the embodiment of the invention, the primary current feed starting point of the ignition coil is controlled with respect to a change of the electric source voltage by using an approximation of a linear function of the electric source voltage. Accordingly, the operation for the control is simplified. Further, the primary current starting point is controlled with a parameter of a value corresponding to the measuring time of the number of revolutions. Accordingly, even if the measuring time is changed, it is not necessary to modify software every time the changed value is set in the ROM.

In the above-mentioned embodiment, the CPU 32 sets data DADV and DDWL in the ADVREG 62 and the DWLREG 70 in accordance with the number of POS pulses. The data DADV and DDWL are the data to be set in the ADVREG 62 and the DWLREG 70. The number of POS pulses used for such purpose may be replaced by a number of clock pulses. In this case, it is necessary to additionally provide a clock generator 230 in the circuit in FIG. 4. Further, the counters ADVC 64 and DWLC 72 count clock pulses from the clock generator 230 in place of the POS pulses. A method to control the ignition period and the primary current flow starting point by using the clock pulses will now be described.

Figure 11:
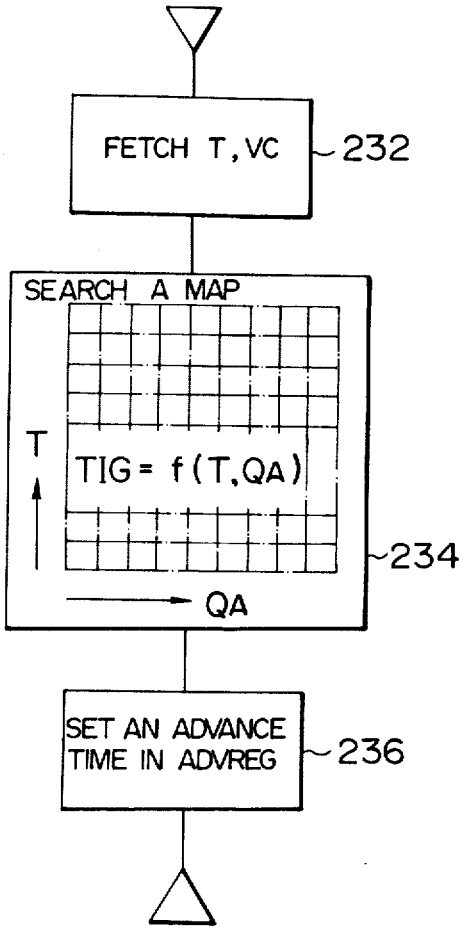
FIG. 11 is a flow chart of another calculation of an ignition timing.

FIG. 11 diagrammatically illustrates a program to determine advance time. In the figure, step 232 of the program fetches an interval T between the previous REF pulse and the present REF pulse and negative pressure VC on the basis of an engine speed. A step 234 searches an advance time map previously stored in the ROM. The advance time TIG is given by TIG = f (T, VC). The advance time TIG thus obtained is set in an advance register ADVREG 62 in a step 236. At this point, the task in FIG. 11 is completed.

Figure 12:
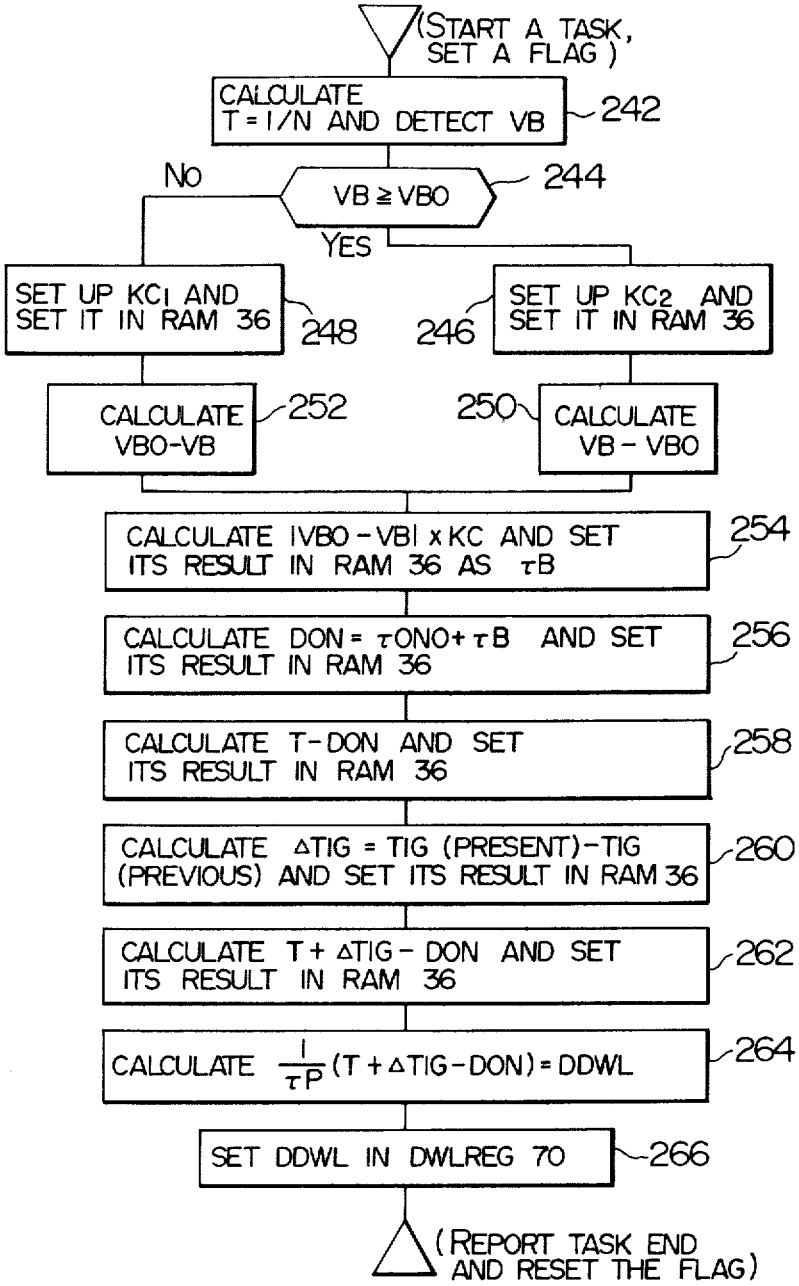
FIG. 12 is a flow chart of another calculation of the current flow duration of the primary current of the ignition coil.

FIG. 12 shows a control program to determine the primary current flow duration. In the figure, a step 242 calculates the interval T between the REF pulses detected and an electric source voltage VB. In a step 244 VB and the reference voltage VBO (FIG. 9) are compared. The reference voltage VBO is a drive voltage given for each ignition coil and provides a given primary coil current when it is applied for 5 m sec, for example. Steps 246 and 248 set approximate proportional coefficients KC1 and KC2 of the electric source voltage. As shown in FIG. 9, the duration $\tau$ON required for energy charging or storage is determined by a continuous curve as an ideal correcting curve with respect to the voltage VB. However, the ideal correcting curve has a non-linearity so that its handling is difficult. For this reason, the ideal correcting curve is tangentially approximated to have a curve indicated by the broken line. With respect to the reference voltage VBO, when VB $\geqq$ VBO, the proportionality constant KC2 is employed, while when VB $<$ VBO, KC1 is used. When the proportional constant KC2 is set up in the step 246, a step 250 performs (VB − VBO). When the proportional constant KC1 is set up in the step 248, a step 256 performs (VBO − VB). Following this operation, a step 254 performs (|VBO − VB|) × KC to obtain a voltage correcting time B. The proportionality constant KC is KC2 if the calculation flow passes through the step 246 and it is KC1 if the flow passes through the step 248.

A step 256 adds the voltage correcting time $\tau$B and the basic current flow duration $\tau$ONO which is the time period to obtain a given current corresponding to the reference voltage VBO (FIG. 9). Accordingly, the necessary energy charging time is obtained by adding the voltage correcting time $\tau$B and the basic current flow duration $\tau$ONO. This duration represents the duration DON in FIG. 3. That is, DON = $\tau$ONO + $\tau$B.

In step 258, the duration or time period DON ($\tau$ONO + $\tau$B) is subtracted from the period T to obtain a dwell setting time, a period of time from ignition to the current flow starting point.

A step 260 calculates the advance angle difference $\Delta$TIG of the ignition timing. The ignition timing varies due to load variation and variation in the engine speed in the course of the repetitive ignitions. For this purpose, it is necessary to correct the ignition timing with the progress of the repetitive ignitions. The advance angle difference $\Delta$TIG is calculated by subtracting the previous ignition timing (PREVIOUS) from the present ignition timing (PRESENT).

A step 258 adds the advance angle difference $\Delta$TIG obtained in the step 260 to the dwell setting time (T − ($\tau$ONO + $\tau$B)) to obtain a true dwell setting time. The dwell setting time is converted into a number of pulses by dividing it by the clock period of the clock generator 230 in FIG. 4, to thereby obtain DDWL. DDWL is given by:

$$DDWL = [(T + \Delta TIG - DON)/\tau P]$$

where $\tau$P is the period of the clock pulses. In step 266, DDWL is set in the DWLREG 70. Through those steps, the task in FIG. 12 is completed.

The current passage starting point of the ignition coil is determined by the dwell setting time and the advance time thus obtained. After a given dwell time, ignition is initiated.

As described above, the ignition timing, or the starting point of the ignition coil current flow, is determined depending on time, so that the accuracy of ignition is improved. Particularly, there is eliminated the necessity of generation of the POS signal by the crank angle sensor. This leads to a simplicity of the crank angle sensor. Additionally, the crank angle sensor may be replaced by a pick-up to produce a time signal corresponding to an angular position of 1° for each single ignition period. Accordingly, the crank angle sensor or the pick-up need not be precisely fixed during engine assembly. In this case, the period T is obtained by measuring the period of the REF pulse as the output signal from the angle sensor 10, in place of the N counter 50 and NREG52 in FIG. 4.

What is claimed is:

1. A method of operating a processor-controlled apparatus for controlling the operation of a combustion engine, said engine including an output shaft driven by mechanical energy converted from heat energy caused by the combustion of fuel, said engine including a source of electrical energy, ignition means, coupled with said source, for cyclically storing energy supplied from said source and discharging energy to be employed for combustion of fuel, detecting means, coupled to said engine output shaft, for producing a reference signal in response to a predetermined angle of rotation of the engine output shaft, and sensor means for producing signals representative of operational conditions of the engine, said method comprising, for each cycle of operation of said ignition means, the steps of:

(a) generating a first signal in response to which said ignition means begins the storage of energy from said source and causing said ignition means to store energy for a prescribed charging duration, and (b) generating a second signal in response to which said ignition means discharges energy stored thereby so as to cause the combustion of fuel in said engine, the time interval from the generation of said second signal to the generation of said first signal corresponding to a predetermined period of time that energy is not being stored by said ignition means, and wherein step (b) comprises the step of:

(b1) in response to a reference signal from said detecting means, generating first data, the value of which is successively changed from a first prescribed value until the value of said first data corresponds to a value representative of the time at which said second signal is to be generated, and thereupon causing the generation of said second signal, and wherein step (a) comprises the step of (a1) in response to the value of said first data corresponding to the value representative of the time at which said second signal is to be generated in step (b), generating second data the value of which is successively changed until the value of said second data corresponds to a value representative of the time at which said first signal is to be generated, and thereupon causing the generation of said first signal, and wherein, for successive cycles of storage and discharge of energy by said ignition means, step (a) further comprises the step of (a2) generating the value representative of the time at which said first signal is to be generated by:

(a2-1) generating third data representative of the interval between the time of occurrence of said second signal for a present cycle and the time of occurrence of said second signal for the previous cycle, (a2-2) generating fourth data representative of said prescribed charging duration, and (a2-3) generating fifth data representative of the time interval from the generation of said second signal to the generation of said first signal in accordance with the difference between said third and fourth data, and wherein step (a1) comprises the step of (a1-1) generating said first signal in response to the value of said second data becoming equal to or greater than the value of said fifth data.

2. A method according to claim 1, wherein step (a2-1) comprises the steps of (a2-1-1) generating sixth data representative of the interval between successive reference signals produced by said detecting means, (a2-1-2) generating seventh data representative of the difference between the value of the present first data at the time at which the present second signal is to be generated and the value of the previous first data at the time at which the previous second signal was generated, and (a2-1-3) combining said sixth and seventh data in accordance with a prescribed relationship to obtain said third data.

3. A method according to claim 2, wherein step (a2-1-3) comprises combining said sixth and seventh data in accordance with the relationship:

said third data = said sixth data ± said seventh data.

4. A method according to claim 1, wherein step (a2-2) comprises the steps of (a2-2-1) generating sixth data representative of the magnitude of the voltage of said source of electrical energy, and (a2-2-2) generating said fourth data in accordance with a prescribed relationship between said fourth data and said sixth data.

5. A method according to claim 4, wherein step (a2-2-2) comprises the steps of:

(a2-2-2-1) comparing said sixth data with seventh data, said seventh data being reference data representative of a predetermined voltage, (a2-2-2-2) generating eighth data representative of a proportionality constant, the value of which corresponds to a first predetermined constant in response to said sixth data being less than said seventh data, and the value of which corresponds to a second predetermined constant in response to said sixth data being larger than said seventh data, (a2-2-2-3) generating ninth data representative of the difference between said sixth data and said seventh data, (a2-2-2-4) generating tenth data representative of the product of said eighth data and said ninth data, (a2-2-2-5) generating said fourth data by arithmetically combining said tenth data with eleventh data, said eleventh data being representative of a prescribed reference time interval during which said ignition means stores energy from said source.

6. A method according to claim 5, wherein step (a2) further comprises the steps of (a2-4) comparing said fifth data with twelfth data which corresponds to a preestablished reference interval of time during which energy is discharged by said ignition means for the combustion of fuel, and (a2-5) changing the value of the fifth data generated in step (a2-3) to said twelfth data upon the value of said fifth data being less than that of said twelfth data, whereby, in step (a1-1) said first signal is generated in response to the value of said second data becoming equal to or greater than the value of said twelfth data.

7. A method of operating a processor-controlled apparatus for controlling the operation of a combustion engine, said engine including an output shaft driven by mechanical energy converted from heat energy caused by the combustion of fuel, said engine including a source of electrical energy, ignition means, coupled with said source for cyclically storing energy supplied from said source and discharging energy to be employed for ignition of fuel, detecting means, coupled to said engine output shaft, for producing reference signals in response to a first predetermined angle of rotation of said engine output shaft and position signals in response to a second predetermined angle of rotation of the engine output shaft, and sensor means for producing signals representative of operational conditions of the engine, said method comprising, for each cycle of operation of said ignition means, the steps of:

(a) generating a first signal in response to which said ignition means begins the storage of energy from said source and causing said ignition means to store energy for a prescribed charging duration, and (b) generating a second signal in response to which said ignition means discharges energy stored therein so as to cause the combustion of fuel in said engine, the time interval from the generation of said second signal to the generation of said first signal corresponding to a predetermined period of time that energy is not being stored by said ignition means, wherein step (b) comprises the step of:

(b1) in response to a reference signal from said detecting means, generating first data the value of which is successively changed from a first prescribed value in accordance with said position signals produced by said detecting means until the value of said first data corresponds to a value representative of the time at which said second signal is to be generated and thereupon causing the generation of said second signal, and wherein step (a) comprises the steps of (a1) in response to the value of said first data corresponding to the value representative of the time at which said second signal is to be generated in step (b), generating second data the value of which is successively changed in accordance with said position signals produced by said detecting means until the value of said second data corresponds to a value representative of the time at which said first signal is to be generated, and thereupon causing the generation of said first signal, and wherein, for successive cycles of storage and discharge of energy of said ignition means, step (a) further comprises the step of (a2) generating the value representative of the time at which said first signal is to be generated by:

(a2-1) generating third data representative of the number of position signals that have been produced between the time of occurrence of said second signal for the present cycle and the time of occurrence of said second signal for the previous cycle, (a2-2) generating fourth data representative of the number of position pulses corresponding to said prescribed charging duration, and (a2-3) generating fifth data corresponding to the difference between said third data and said fourth data, said prescribed charging duration being established in accordance with the resulting value of said fifth data.

8. A method of operating a processor-controlled apparatus for controlling the operation of a combustion engine, said engine including an output shaft driven by mechanical energy converted from heat energy caused by the combustion of fuel, said engine including a source of electrical energy, ignition means, coupled with said source, for cyclically storing energy supplied from said source and discharging energy to be employed for the combustion of fuel in accordance with control signals applied thereto, detecting means, coupled to said engine output shaft, for producing a reference signal in response to a predetermined angle of rotation of the engine output shaft, and sensor means for producing signals representative of operational conditions of the engine in response to which processor-based control signals are generated for controlling said ignition means, said method comprising, for a respective cycle of operation of said ignition means, the steps of:

(a) generating a first control signal in response to which said ignition means begins the storage of energy from said source and causing said ignition means to store energy for a prescribed charging duration, and (b) generating a second control signal in response to which said ignition means discharges energy stored thereby so as to cause the combustion of fuel in said engine, the time interval from the generation of said second control signal to the generation of said first control signal corresponding to a predetermined period of time that energy is not being stored by said ignition means, and wherein step (a) comprises the steps of:

(a1) generating a first data signal representative of the interval between the time of occurrence of the second control signal for the previous ignition cycle and the time of occurrence of the second control signal generated for the present ignition cycle, relative to the rotation of the engine output shaft;

(a2) generating a second data signal representative of said prescribed charging duration for the present ignition cycle in accordance with operational conditions of the engine, and (a3) generating said first control signal in accordance with a prescribed relationship between said first and second data signals.

9. A method according to claim 8, wherein said prescribed relationship is defined in accordance with the difference between said first and second data signals.

10. A method according to claim 8, wherein said detection means includes means for producing position pulses in response to a prescribed angle of rotation of the engine output shaft less than that for which said reference signals are produced, and wherein said second data signal generated in step (a2) is generated in response to the production of position pulses by said detection means.

11. A method according to claim 8, wherein said sensor means includes means for generating an output representative of the operational state of said electrical energy source and wherein said second data signal is generated in step (a2) in accordance with said output.

12. A method according to claim 8, wherein step (b) comprises the steps of:

(b1) generating a third data signal the value of which is successively changed until the value of said third data signal reaches a predetermined value and thereupon generating a first output signal, and (b2) in response to said first output signal, generating a fourth data signal the value of which is successively changed until the value of said fourth data signal reaches a prescribed value and thereupon generating said second control signal.

13. A method according to claim 12, wherein said detection means includes means for producing position pulses in response to a prescribed angle of rotation of the engine output shaft less than that for which said reference signals are produced, and wherein the values of said third and fourth data signals are successively changed in response to the production of said position pulses.

14. A method according to claim 13, wherein said sensor means includes means for generating an output representative of the operational state of said electrical energy source and wherein said second data signal is generated in step (a2) in accordance with said output.

15. A method according to claim 12, wherein said apparatus further comprises means for supplying a sequence of clock pulses, and wherein the values of said third and fourth data signals are successively changed in response to said clock pulses.

16. A method according to claim 15, wherein said first control signal is defined in accordance with the period of said clock pulses.

17. A method according to claim 12, wherein said sensor means includes means for generating an output representative of the operational state of said electrical energy source and wherein said second data signal is generated in step (a2) in accordance with said output.

18. A method according to claim 15, wherein said clock pulses are produced in accordance with the rotation of said engine output shaft.

19. A method according to claim 15, wherein said clock pulses are produced from a clock source separate from said engine output shaft.

20. A method according claim 11, wherein step (a2) comprises the steps of (a2-1) comparing said output to a prescribed reference value representative of a predetermined output of said electrical energy source, (a2-2) generating a charging duration correction signal in accordance with a prescribed function the value of which varies in dependence upon the difference between said output and said prescribed reference value and whether or not said prescribed reference value is no greater than or exceeds said reference value, (a2-3) generating said second data signal in accordance with said charging duration correction signal.

* * * * *